United States Patent [19]

Cox

[11] Patent Number: 4,739,840

[45] Date of Patent: Apr. 26, 1988

[54] METHOD AND APPARATUS FOR PROTECTING A SHALLOW WATER WELL

[75] Inventor: Bobby E. Cox, Kenner, La.

[73] Assignee: Shell Offshore Inc., Houston, Tex.

[21] Appl. No.: 936,191

[22] Filed: Dec. 1, 1986

[51] Int. Cl.[4] ..... E02B 17/02; E02D 31/00

[52] U.S. Cl. ..... 175/9; 405/195; 405/227

[58] Field of Search ..... 175/9; 405/195, 211, 405/216, 203, 227, 201

[56] References Cited

U.S. PATENT DOCUMENTS

| | | | |
|---|---|---|---|
| 3,362,170 | 1/1968 | Manning | 175/9 |
| 3,389,562 | 6/1968 | Mott et al. | 405/227 X |
| 3,483,708 | 12/1969 | Marshall | 175/7 X |
| 3,508,409 | 4/1970 | Cargile, Jr. | 175/5 X |
| 4,069,683 | 1/1978 | Jansz | 405/228 X |
| 4,084,385 | 4/1978 | Boyadjieff | 405/228 |
| 4,109,476 | 8/1978 | Gracia | 405/203 |
| 4,110,993 | 9/1978 | Heerema | 405/228 |
| 4,228,857 | 10/1980 | Nobileau | 175/7 X |
| 4,269,542 | 5/1981 | Mueller | 405/203 |
| 4,391,332 | 7/1983 | Fayren | 166/350 |
| 4,401,398 | 8/1983 | Remson | 166/367 X |
| 4,421,438 | 12/1983 | Abbott et al. | 405/227 |
| 4,422,805 | 12/1983 | Sweatman | 405/227 |
| 4,422,806 | 12/1983 | Abbott et al. | 405/227 |
| 4,431,344 | 2/1984 | Abbott et al. | 405/227 |
| 4,437,791 | 8/1984 | Reynolda | 405/195 |
| 4,558,973 | 12/1985 | Blandford | 405/227 |
| 4,592,422 | 6/1986 | Hipp | 405/227 |

FOREIGN PATENT DOCUMENTS

| | | | |
|---|---|---|---|
| 8401934 | 1/1986 | Netherlands | 405/227 |
| 1563107 | 3/1980 | United Kingdom | 405/227 |
| 0628232 | 10/1978 | U.S.S.R. | 405/227 |

*Primary Examiner*—Stephen J. Novosad
*Assistant Examiner*—Bruce M. Kisliuk

[57] ABSTRACT

Method and apparatus for reinforcing a shallow water unsupported well conductor by positioning a well jacket adjacent the well conductor, raising the jacket to a selected height above the ocean floor, driving pile through the legs of the jacket, connecting each pile to a surrounding leg and operatively connecting the jacket to the well conductor with the jacket being supported on the piles above the ocean floor.

22 Claims, 3 Drawing Sheets

FIG. 4
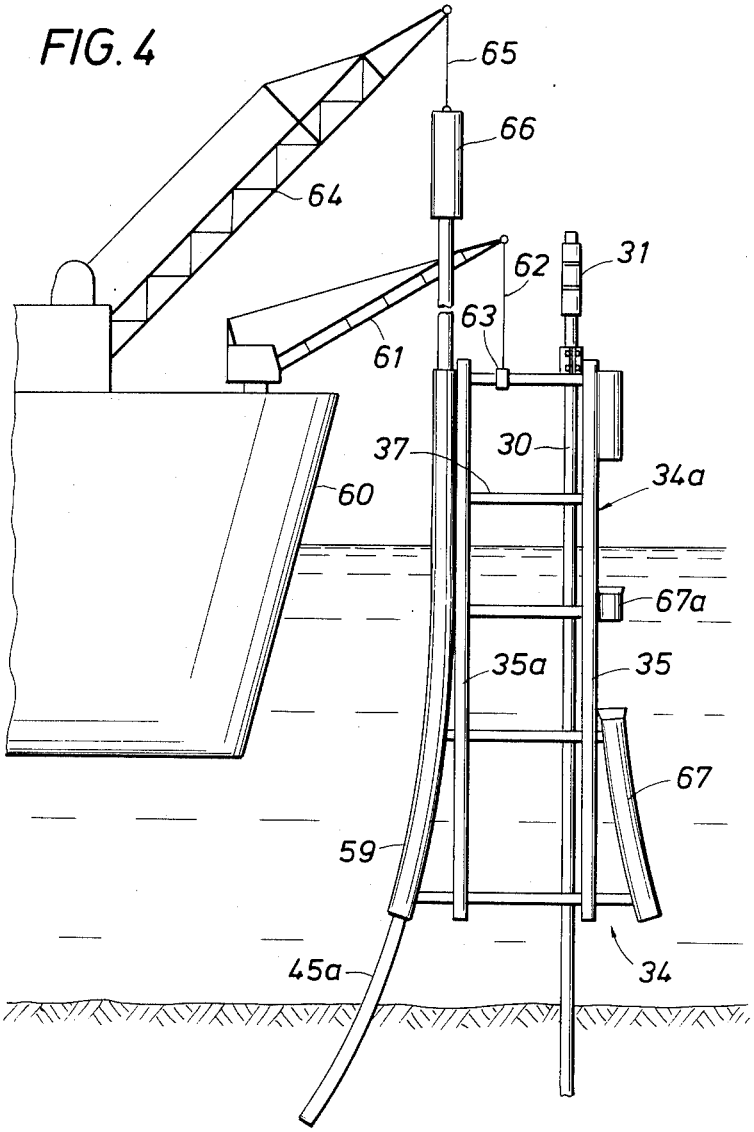
FIG. 5
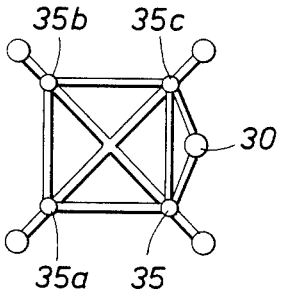
FIG. 6
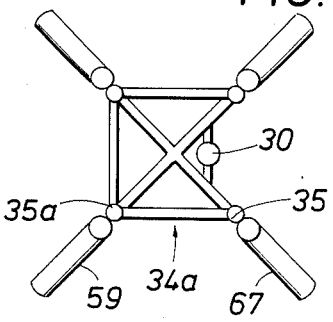
FIG. 9
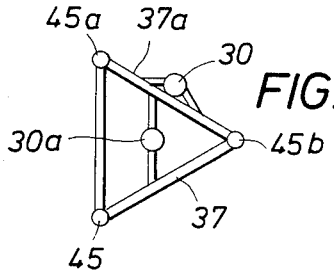
FIG. 10
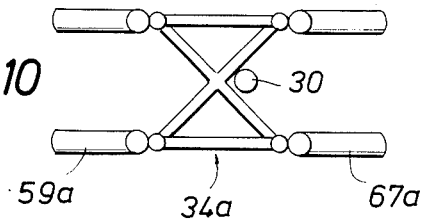
FIG. 12
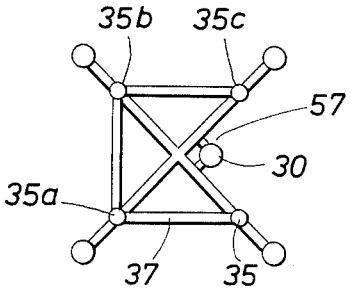
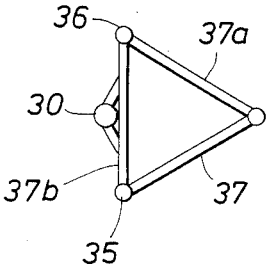
FIG. 11

METHOD AND APPARATUS FOR PROTECTING A SHALLOW WATER WELL

This invention relates to a method and apparatus for protecting the well conductor of a shallow water well which may be drilled from a jack-up rig in locations where only a few wells are to be drilled.

BACKGROUND OF THE INVENTION

From time to time, offshore structures in the form of large offshore platforms are erected on the ocean floor for the purpose of drilling a large number of wells into the ocean floor in order to develop and oil or gas fields. In shallow water locations where small amounts of oil and gas have been found, the erection of a large platform could not be economically justified. Thus, at times, only a single well need be drilled down to the oil deposit. Alternatively, single wells are often drilled in extensions of known fields to develop small deposits. At other times, it is often desired to drill a single well and evaluate the field production for a year prior to going forward with further drilling of that area.

In shallow water of, say, 50 to 150 feet in depth, a single well would be drilled by driving a large-diameter drive pipe or well conductor into the ocean floor from a jack-up rig. The well conductor, which may be 48 inches in diameter, forms the outer tubular member of a well installation. A well is drilled through the well conductor in a manner well known to the art and then is closed at the top by a well head assembly of the type used in producing a well. A single well of this type is normally protected by fabricating onshore a well protector jacket which is normally square in cross-section and extends for a height equal to the distance between the ocean floor and the wellhead at the top of the well conductor, say, 50 to 75 feet above the water surface. Such a jacket is transported by barge or otherwise to the offshore location where a derrick barge is employed to lift the jacket above the wellhead and slip it down over the wellhead and well conductor to the ocean floor. Piles are then driven down through the corner legs of the jacket to anchor it to the ocean floor.

SUMMARY OF THE INVENTION

The present invention is directed to apparatus for reinforcing shallow water wells and a method for installing the apparatus at an offshore location. The present apparatus includes simple structural components that require a minimum of labor offshore in connecting the apparatus to a well conductor. The apparatus is designed so that only connections are made above the water line to facilitate the assemblage of the apparatus.

It is an object of the present invention to provide an apparatus to be positioned adjacent and connected to a well conductor to aid the conductor in resisting the forces of wind and waves to which it is subjected.

It is a primary object of the present invention to provide a method of drilling a shallow water offshore well and reinforcing the well structure from a jack-up type drilling platform having a derrick and associated drilling and hoisting systems thereon. The method contemplates employing a jack-up drilling platform for driving the well conductor, drilling the well through the conductor, and subsequently reinforcing the well conductor with the apparatus of the present invention and driving piles through the reinforcing apparatus without moving the jack-up platform from its original drilling position. The jack-up platform is provided with a drilling rig or derrick which is moveable laterally on its base platform or operating platform so that the derrick may be moved to an operative position within a prescribed work area which is outboard of the elevated operating platform over open water. A jack-up platform having its derrick on a cantilevered section of the platform may be employed or, alternatively, a jack-up rig having a drilling slot in the platform extending inwardly from the outer edge thereof, may be used. Thus, in either case a jack-up platform is employed which is of a design that provides for the derrick to be moved laterally on the platform within a prescribed work area so that the center line of the derrick, and thus its hoist system, is positioned over open water to one side or outboard of the platform, or over the slot therein if the platform has one.

The jack-up drilling platform is located at a selected shallow water drilling location and its leg footings are set on the ocean floor while subsequently the operating deck is jacked up to the normal operating position above the water surface and wave action. By use of the hoist system of the derrick, a large diameter well conductor, say, 48 inches in diameter, is lowered through the water below the derrick and set into the ocean floor. Generally, the well conductor is driven into the ocean floor by means of a pile driver to refusal. A well is drilled through the well conductor from the jack-up platform and the top of the well conductor is closed by means of a conventional wellhead.

In order to reinforce the finished well installation, a relatively small reinforcing well structure in the form of a tower equipped with pile sleeves, which has been previously fabricated onshore, is transported to the jack-up platform where one side of it is positioned adjacent the well conductor and on the ocean floor. At least the lower portion of the reinforcing well structure is provided with downwardly-directed pile guide sleeves of 10 feet or more in length through which piles may be driven into the ocean floor. With the reinforcing well structure standing on the ocean floor next to the well conductor, the derrick of the jack-up platform is moved so that the center line thereof is over one of the pile guide sleeves of the reinforcing tower. The hoist system of the derrick then picks up from 40 to 80 feet of pile, stabs it into the upper end of the sleeve above the water surface, lowers it through the pile guide sleeve and, by means of a pile driver, drives it into the ocean floor. Additional lengths of pile are welded to the upper end of the driven pile at the operating deck of the platform in a manner well known to the art. After the piles have been driven to the selected depths, the reinforcing well structure is picked up off the ocean floor by the derrick hoist or other means and is raised, with the sleeves sliding along the piles, until the upper end of the tower is at a selected level below the wellhead assembly at the top of the well conductor. The piles are then connected to the sleeves of the reinforcing tower in any suitable manner. The tower is also connected to the well conductor either after the piles and sleeves are connected.

By employing the method and apparatus of the present invention, well conductors of thinner-walled pipe may be satisfactorily employed when reinforced in accordance with this invention. Additionally, single well conductors may be used in deeper waters with satisfactory results when protected in the present manner.

Instead of following the normal procedure of drilling an offshore well from a drilling vessel, then moving the vessel off location, then subsequently moving back onto the location with a derrick barge and a reinforcing structure to be positioned over around the offshore well, it is an object of the present invention to provide a method and apparatus whereby all of the operations of drilling and reinforcing the well assembly can be carried out from a jack-up platform without ever moving off location until the entire operation has been completed. This would reduce the cost of the operations about $1,000,000 by utilizing the present method.

BRIEF DESCRIPTION OF THE DRAWING

These and other objects of the present invention will appear hereinafter from a consideration of the drawing and description.

FIG. 4 is a partial side elevation view diagrammatically illustrating the driving of pile during the field installation of one form of the reinforcing apparatus of the present invention;

FIGS. 5, 6, 9, 10, 11, and 12 are plan views illustrating various arrangements of the reinforcing apparatus of the present invention when used on one or two wells.

DESCRIPTION OF A PREFERRED EMBODIMENT

Figure 1:
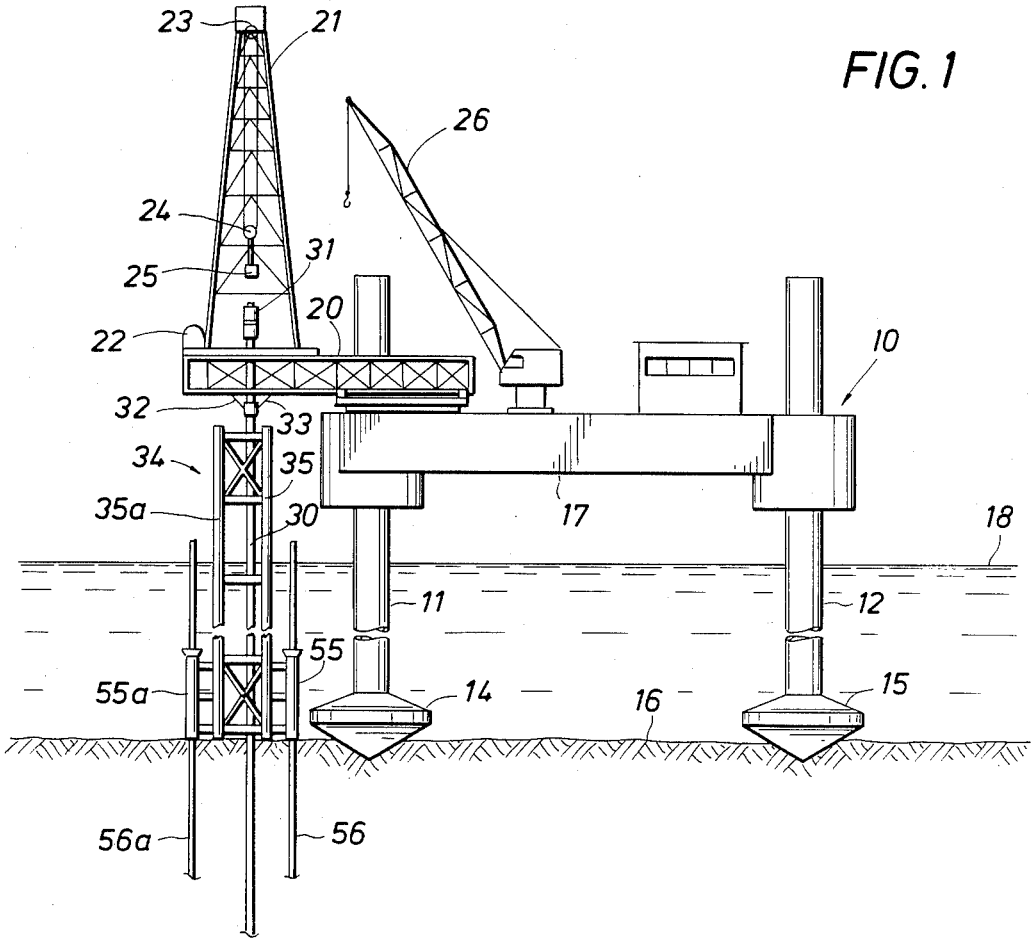
FIG. 1 is a side elevation view of a jack-up platform with a moveable derrick shown after drilling a well in the ocean floor.

Referring to FIG. 1 of the drawing, an offshore jack-up platform or rig 10 is illustrated as being positioned at a drilling location offshore. Two of its three legs 11 and 12 are shown as having been jacked down so that the footings 14 and 15 at the lower end thereof rest on the ocean floor 16 with the operating platform 17 of the jack-up rig having been elevated above the ocean surface 18. In this case the jack-up rig 10 is provided with a cantilevered section of the operating deck 20 which extends outboard of the main deck section 17. A drilling derrick 21 is mounted on the cantilevered section of operating deck 20. The derrick 21 is provided with a normal hoist system comprising a hoist 22, crown block 23, travelling block 24, and elevators 25 or other connection means for connecting and lowering pipe into a well or lowering a pile driver 66 (FIG. 4) to drive pile into the ocean floor. A crane 26 is shown as positioned on the deck of the platform to aid in carrying out operations.

Figure 2:
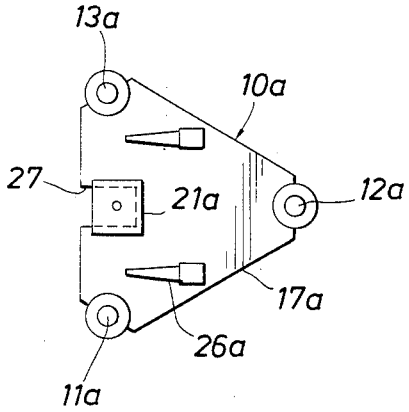
FIG. 2 is a plan view of another type of a jack-up platform having a slot in the operating platform.

In FIG. 2, another form of jack-up platform is shown as having legs 11*a*, 12*a* and 13*a* at the three corners of the triangular-shaped hull which may form the operating deck of the platform 10*a*. The operating deck 17*a* is shown as being provided with a slot 27 which extends inwardly from the outer edge of the deck or hull 17*a* a distance of, say, 35 or 40 feet. The width of the slot 27 is generally about 25 feet. The derrick 21*a* is shown as spanning the slot 27 and is moveable along the length and across the width of the slot as desired. Thus, with the platform located in its drilling position as shown in FIG. 1, the derrick can be moved laterally relative to the outer edge of the operating deck so that the same derrick hoist system can be used to drive pile through a reinforcing well structure after the well has been drilled without moving the jack-up platform on the ocean floor.

In FIG. 1 a well has been drilled through a well conductor 30 and is diagrammatically shown as being closed by a wellhead assembly 31. During drilling operations the well conductor may be supported in any suitable manner from the platform 20 as by means of cables 32 and 33. The platform of FIG. 2 may be provided with one or more cranes 26*a*.

The reinforcing frame and well structure takes the form of a slender substantially rigid elongated tower of a height sufficient to extend from a point adjacent and below the production wellhead assembly to a point near and above the ocean floor, with the major height of the tower being below the water surface. At least three downwardly-directed leg members form the legs of the tower, said members being arranged in fixed spaced relationship by lateral bracing members, such that, when taken in plan view, at least three downwardly-directed leg members are arranged in a polygonal configuration. At least three downwardly-directed pile sleeves are fixedly carried by said tower. A pile is positioned within at least each of the pile sleeves and extends out the bottom thereof and through a water interval above the ocean floor and into the ocean floor a distance sufficient to anchor the pile therein.

Connector means fixedly secure each of said piles to its surrounding pile sleeve, and means are carried by said structure above the water surface on a side adjacent the well conductor for operatively connecting said well conductor to said structure to reinforce the well conductor.

Figure 3:
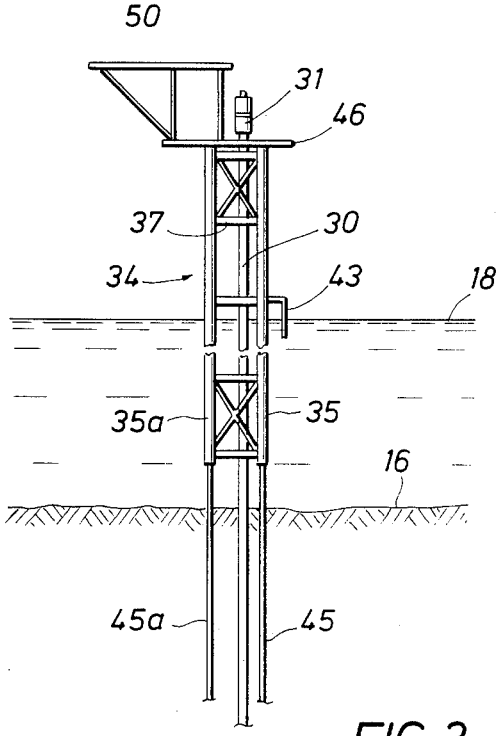
FIG. 3 is a side elevation view of one form of a reinforcing well structure in accordance with the present invention.

One form of reinforcing frame or well structure to be used to reinforce an unsupported well conductor in shallow water may take the form of a pile guide template frame and well structure 34. The pile guide template frame and well structure 34 comprises at least three and preferably four downwardly-extending open-ended tubular pile guide sleeves 35 and 35*a* (FIG. 8) of, say, an internal diameter of 40 inches so as to pass a 36-inch diameter pile therethrough. The frame 34 in FIGS. 3 and 12 is shown as a slender elongated tower having four tubular legs 35, 35*a*, 35*b* and 35*c* being provided with laterally extending support members or braces 37. In FIG. 3, the legs 35 and 35*a* of the frame or tower 34 form the pile guide sleeves through which piles 45 and 45*a* have been lowered and driven into the ocean floor. In the arrangement shown in FIG. 1, skirt pile sleeves 55 and 55*a* are rigidly connected to the lower end of the legs 35 and 35*a* of the tower or frame 34. Piles 56 and 56*a* are driven through the sleeves 55 and 55*a* into the ocean floor. The sleeves and piles are connected by grouting with the frame being held off the ocean floor. In the event that boats are used to transfer personnel to a well installation to inspect it, the pile guide frame 34 is provided with a boat landing and bumper 43 (FIG. 3).

The distance between the legs 35 and 35*a* is determined by the type of drilling jack-up platform that is used. In the plan view shown in FIGS. 5, 6, 9, 10, 11 and 12, the overall cross-sectional width of the structure must be less than the width, say, 25 feet, of the slot 27 of a jack-up rig as illustrated in FIG. 2. Alternatively, if the rig of FIG. 1 is employed, the distance between the furthermost pile sleeves of the frame 34 must be within the range of the operational lateral movement of the center line of the derrick 21 on a cantilevered section of operating deck 20 of platform 10.

In FIG. 4, an alternate method of employing a work barge 60 having cranes 61 and 64 may be used to install a reinforcing frame 34 and drive pile through the pile sleeves thereof. It is to be remembered however, that all of the operations are normally carried out from the jack-up platform of FIG. 1 without moving the platform 10 away from the well conductor and well assembly 31 which has been drilled in the ocean floor, as shown in FIG. 1.

In FIG. 4 the pile guide template frame and well structure 34 of FIG. 3 has been transported in any suitable manner, as by barge, out to the jack-up platform where it is picked up by any suitable hoist means on the jack-up platform and positioned adjacent or against the well conductor 30 as in a V-opening 57 formed by the cross bracing (FIG. 12) of the tower 34, or outside the tower (FIG. 5). Braces 58 may be installed in the field between the tower bracing and the well conductor 30. Preferably, the frame 34 is set on the ocean floor (FIG. 1) when straight pile is driven but is hung above the ocean floor (FIG. 4) when driving pile through curved pile sleeves 59 or 67.

With the pile guide frame in place, the derrick 21 is moved laterally until its center line is positioned directly over one of the pile guide sleeves 35 or 35*a* in FIG. 3, or over sleeves 55 or 55*a* of FIG. 1. Lengths of pile are then picked up one at a time and lowered down through the sleeve 35. Additional lengths of pile are welded to the upper end of the pile section being lowered in a manner well known to the art and the pile is driven into the ocean floor, as by means of a pile driver in a manner well known to the art. The pile, when driven in place, is illustrated at 45 in FIGS. 1 and 3. A follower pile may be used, if desired.

The derrick 21 is then moved laterally to a position over the other spaced-apart pile 35*a* (FIG. 3), or pile 56*a* (FIG. 1), and the operation of picking up piles, lowering them through the pile sleeve 35*a* and driving them into the ocean floor is repeated. After the desired number of piles have been driven, the entire frame 34 and its pile sleeves is picked up off the ocean floor, sliding it up along the piles 45 or 56 until the top of the frame 34 is at a selected distance relative to the wellhead assembly so that a personnel platform 46 and related structure can be landed on the tops of legs 35 or piles 45 therein. With the frame being held above the ocean floor, each of the piles 45 is fixedly secured to the surrounding pile sleeve in any manner well known to the art. For example, the top of each pile in FIG. 3 may be connected to its surrounding sleeve by means of welding to spacers or shims. In FIGS. 1 and 3, the annular space formed between each pile and its surrounding sleeve may be filled with cement grout in a manner well known to the art to connect the pile and sleeve together. Any extra pile extending above the sleeves may be cut off.

Figure 7:
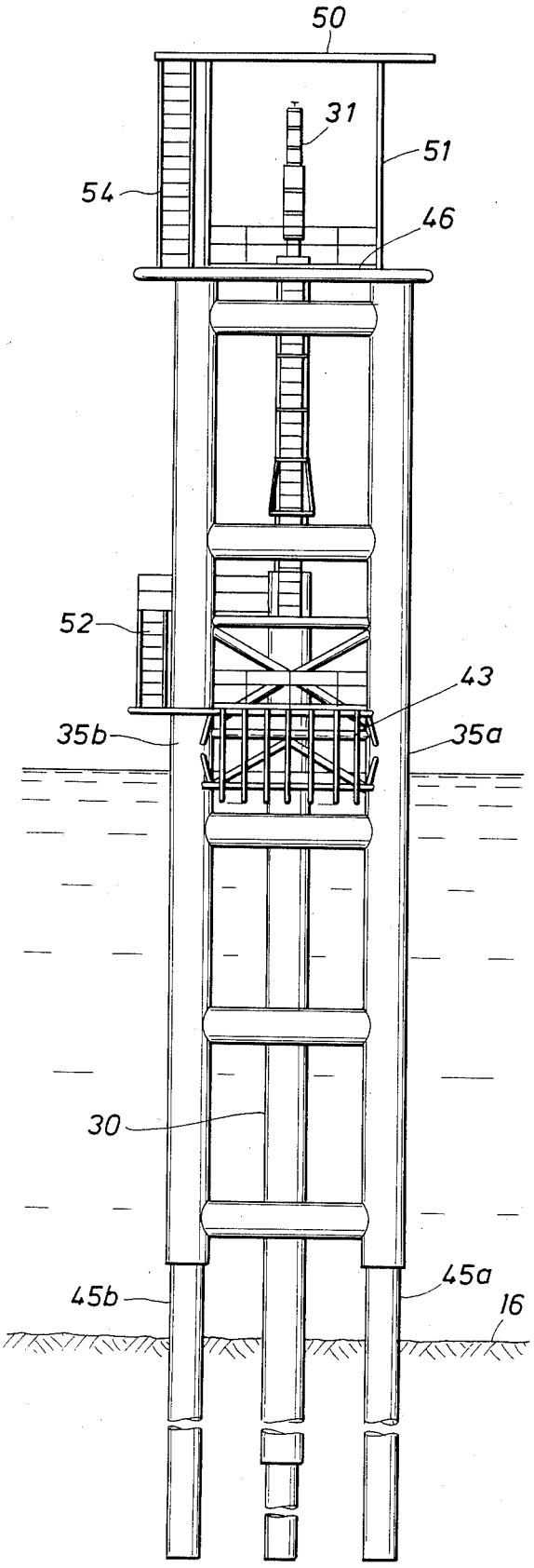
FIGS. 7 and 8 are side and front elevation views of a typical reinforced shallow water well.
Figure 8:
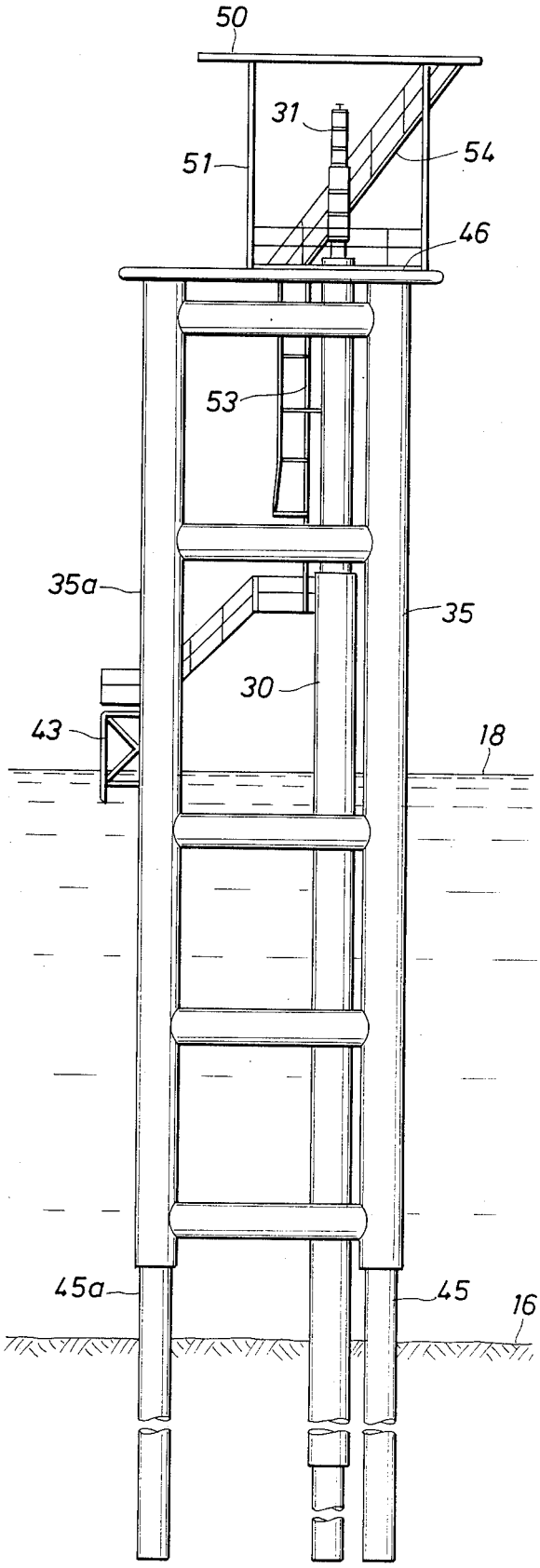

Subsequently, the operating platform 46 may be mounted and affixed to the top of the frame 34 and/or near the top of the well conductor 30 below the wellhead assembly to allow personnel or maintenance men to inspect or maintain the well. If desired, a helicopter pad 50, as illustrated in FIGS. 3, 7 and 8, may be mounted above the wellhead assembly 31 by means of a suitable support assembly or frame 51 which in turn is secured to the operating platform 46 and thence to the wellhead conductor 30. Suitable stairways or ladders 52, 53 and 54 can be provided so that personnel can move from the boat landing 43 or helicopter pad 50 to the operating platform 46. All of the elements 46, 50, 51 and 54 may be assembled onshore as a unit and landed on the top of the frame together.

In FIGS. 9 and 10 pile sleeve support frame configurations are shown which provide for two wells 30 and 30*a* in FIG. 9 with well 30*a* being separately supported to the support members 37 and 37*a* by additional cross bracing members. It is to be noted that a subsequently drilled well 30*a* may be installed within the periphery of the triangle formed between the piles 45, 45*a*, and 45*b* and the well 30. In FIG. 10, the wells 30 and 30*b* are on the periphery of the polygonal configuration of the reinforcing frame.

In order to obtain greater stability for the frame 34*a*, the legs thereof may be curved outwardly at the lower end thereof or, alternatively, curved pile guides 59 or 67 (FIG. 4) may be affixed to the outside of the tower or frame in a manner well known to the art to serve as pile sleeves for piles 45*a* to be driven into the ocean floor. The top of the curved pile sleeve 59 is preferably straight for a short distance so as to facilitate the entry of a pile thereinto. If desired, straight or pre-curved pile may be used. As shown in FIG. 6, a curved guide 59 may extend from the frame 34*a* in a diagonal direction, or parallel to the frame, as shown in FIG. 10. It is to be noted that in all cases it is the piles extending below the bottom of the frame or tower 34 or 34*a* that support the reinforcing structure, for the well conductor, above the ocean floor for up to 20 feet or more.

In FIG. 4, the pile driving operation of the method of the present invention is illustrated as being carried out from a work barge 60, or any other suitable vessel equipped for pile driving which may float, or sit on the ocean floor. The barge 60 is provided with a crane 61 or other suitable equipment, having a hoist cable 62 and hook 63, for lowering the frame 34*a* to a selected distance above the ocean floor and for temporarily supporting the frame 34*a* in the water and adjacent or against the well conductor 30 prior to driving pile 45*a* through guide sleeve 59. The work barge 60 is also provided with a hoisting crane 64 having a hoist cable 65 secured to the upper end of a suitable pile driver or hammer 66 which is adapted to engage or be operatively connected to a pile 45*a* to be driven.

As shown in FIG. 4, the work barge is anchored within working range of the unsupported well conductor 30. By use of a crane 64, the frame 34 has been picked up and lowered to the ocean floor.

In FIG. 4 the pile guide template frame 34*a* has been transported in any suitable manner, as by barge 60, out to be unsupported well conductor 30 where it is picked up by any suitable hoist means 61 on the work barge 60 and positioned so that the frame 34*a* is hung off the barge 60 with the top of the frame adjacent and below the wellhead 31 at the deisred level against the well conductor 30.

With the pile guide frame 34*a* in place above the ocean floor, the crane 64 is moved until its hoist cable 65 is positioned directly over one of the pile guide sleeves 59 or 67. Lengths of pile are then picked up one at a time and lowered down through a sleeve and then down through the sleeve. Additional lengths of pile are welded to the upper end of the pile section being lowered in a manner well known to the art and the pile is driven into the ocean floor, as by means of a pile driver 66 in a manner well known to the art. The pile, when driven in place, is illustrated at 45a in FIG. 4. A follower pile may be used, if desired. The tops of the piles are the cut off near the top of the guide sleeve and connected thereto.

The crane 64 is then moved to a position over the other spaced-apart pile sleeve and the operation of picking up piles, lowering them through the pile sleeve and driving them into the ocean floor is repeated. Each of the piles is fixedly secured to the surrounding pile sleeve in any manner well known to the art. For example, the top of each pile may be connected to its surrounding sleeve above the water by means of welding to spacers or shims. Additionally and/or alternatively, the annular space formed between each pile and its surrounding sleeves may be filled with cement grout in a manner well known to the art.

I claim as my invention:

1. A method of drilling a shallow-water offshore well and reinforcing a well structure thereof from a jack-up type drilling platform having a derrick and associated drilling and hoisting systems, said platform being of a design providing for the derrick to be moved laterally on the platform within a prescribed work area so that the center line of the derrick is positioned over open water outboard of the platform, said method comprising the steps of:

a. providing a jack-up drilling platform and locating it at a selected shallow-water drilling location with its leg footings on the ocean floor and its operating deck jacked-up to normal operating position above the water surface and wave action;

b. lowering a large-diameter well conductor through the water below the derrick and setting it in the ocean floor;

c. drilling a well through said well conductor and closing the top of the well with a wellhead;

d. providing a pile guide template frame substantially polygonal in plan view comprising at least three spaced-apart downwardly-directed pile guides connected together by laterally-extending support members, said frame having a height at least equal to the depth of the water at the well;

e. transporting the pile guide template frame to the shallow water offshore well;

f. positioning said frame vertically in the water adjacent the well conductor;

g. lowering a pile through each of said pile guides of said frame and driving said pile into the ocean floor;

h. raising the template frame along the anchored piles until the top of the frame is at a selected elevation relative to the wellhead at the top of the well conductor with the bottom of the frame above the ocean floor and a major portion of the frame below the water surface;

i. fixedly connecting each pile to its surrounding pile guide while the template frame is raised; and j. operatively connecting at least the top of the frame to the well conductor, whereby said frame forms an interconnecting reinforcing structure between the piles and the well conductor, substantially polygonal in plan view, to resist the effect of wind and wave forces encountered by said well conductor.

2. The method of claim 1 including the steps of providing a work platform on the frame below said wellhead, and fixedly securing said work platform to said frame.

3. The method of claim 2 including the steps of providing a helicopter pad and a depending support frame, and fixedly securing said helicopter pad support frame to at least said work platform.

4. The method of claim 1 wherein the operation carried out in step (j) is accomplished by providing a sliding connection permitting limited movement between the well conductor and the interconnecting reinforcing structure.

5. The method of claim 1 wherein in step (f) the frame is positioned by hanging it from jack-up drilling platform beneath the derrick thereof while the frame is moved to a position adjacent said well conductor.

6. The method of claim 1 wherein between steps (f) and (g) the derrick is moved laterally on said drilling platform so that a travelling block of the derrick hoisting system is vertically aligned with said pile guides, one at a time, and including the step of connecting the derrick hoisting system to one end of a pile to raise it within the derrick and lower it through a pile guide of said frame.

7. The method of claim 1 wherein in step (f) the frame is lowered to and positioned on the ocean floor prior to the pile driving operation.

8. The method of claim 1 wherein each of said piles is connected to its pile guide by grouting.

9. The method of claim 1 wherein in step (d) the dimensions of the pile guide template frame together with that of the well conductor, when taken in cross-sectional plan view, are less than that of a slot of jack-up platform.

10. The method of claim 9 including the steps of lowering the jack-up platform to the water surface, retracting the leg footings to the travelling position, and moving the platform on the water in a direction such that the well conductor and the reinforcing pile guide template frame and well structure move out the open end of the platform slot.

11. The method of claim 1 wherein the jack-up drilling platform is provided with a drilling slot extending inwardly from the outer edge of the platform deck with the derrick and its hoist system spanning the drilling slot and being moveably positionable laterally so that the derrick hoist system may be moved to selected locations along at least portions of the width and length of the drilling slot, moving said derrick laterally to a position such that the derrick hoist system is above a vertical pile guide of said frame, picking up a length of pile with said derrick hoist system prior to lowering it through said pile guide as per step (g), and, after driving the pile in the ocean floor, repositioning said derrick and said hoist system to a position above another pile guide and repeating the pile installation operation.

12. The method of claim 1 wherein in step (h) the bottom of the frame is raised up to 25 feet above the ocean floor.

13. An offshore well structure adapted to be positioned adjacent an unsupported well conductor installed in the ocean floor and having a well drilled therethrough and closed at the upper end above the wave height by a production wellhead assembly, said well structure being adapted to be operatively connected to the unsupported well conductor for reinforcing it and increase its resistance to the effect of wind and wave forces, said well structure comprising:

a. a slender substantially rigid elongated tower of a height sufficient to extend from a point near and above the ocean floor, with a major height of the tower being below the water surface;

b. at least three downwardly-directed leg members forming the legs of the tower, said members being arranged in fixed spaced relationship by lateral bracing members, such that, when taken in plan view, at least three downwardly-directed leg members are arranged in a polygonal configuration;

c. at least three downwardly-directed pile sleeves fixedly carried by said tower;

d. a pile positioned within at least each of the pile sleeves and extending out the bottom thereof and through a water interval above the ocean floor and into the ocean floor a distance sufficient to anchor the pile therein;

e. connector means fixedly securing each of said piles to its surrounding pile sleeve; and f. means carried by said structure above the water surface on a side adjacent the well conductor for operatively connecting said well conductor to said structure to reinforce the well conductor.

14. The apparatus of claim 13 wherein the downwardly-directed pile sleeves are incorporated in the leg members of the tower.

15. The apparatus of claim 13 wherein the pile sleeves are positioned outboard of the leg members and including bracing members extending between the pile sleeves and the lower portion of the tower to connect the pile sleeves rigidly to the tower.

16. The apparatus of claim 15 wherein the tops of the pile sleeves positioned outboard of the leg members are at least 20 feet below the water surface.

17. The apparatus of claim 13 wherein the piles and the pile sleeves are tubular members, with the piles having an outer diameter at least two inches less than the internal diameter of the pile sleeves whereby an annular space is formed between a pile and the inner surface of the pile sleeve surrounding it.

18. The apparatus of claim 17 including a cementing material injected into the annular spaces between the piles and the pile sleeves to connect them together.

19. The apparatus of claim 15 wherein at least some of the pile sleeves and the piles positioned therein curve outwardly and downwardly.

20. The apparatus of claim 19 wherein the piles are curved from 1 to 10 degrees over the height of the tower.

21. The apparatus of claim 20 wherein the piles are precurved prior to inserting them in the pile sleeves.

22. The apparatus of claim 19 wherein the upper end of the pile sleeves are vertical for a short distance before curving outwardly and downwardly.

* * * * *